US008226283B2

(12) United States Patent
Gebauer et al.

(10) Patent No.: US 8,226,283 B2
(45) Date of Patent: Jul. 24, 2012

(54) ILLUMINATION DEVICE

(75) Inventors: Matthias Gebauer, Reutlingen (DE); Hubert Zwick, Stuttgart (DE)

(73) Assignee: Automotive Lighting Reutlingen GmbH (DE)

( * ) Notice: Subject to any disclaimer, the term of this patent is extended or adjusted under 35 U.S.C. 154(b) by 530 days.

(21) Appl. No.: 12/481,761

(22) Filed: Jun. 10, 2009

(65) Prior Publication Data

US 2010/0027282 A1 Feb. 4, 2010

(30) Foreign Application Priority Data

Jul. 31, 2008 (DE) ..... 10 2008 035 765

(51) Int. Cl.
*F21V 11/00* (2006.01)

(52) U.S. Cl. ..... 362/522; 362/519; 362/517; 362/518

(58) Field of Classification Search ..... 362/511, 362/512, 517–518, 347, 348, 350, 353, 548, 362/549, 296, 297, 341
See application file for complete search history.

(56) References Cited

U.S. PATENT DOCUMENTS 6,953,271 B2 * 10/2005 Aynie et al. ..... 362/511
7,452,114 B2 * 11/2008 Gasquet ..... 362/511
7,753,561 B2 * 7/2010 Chaves et al. ..... 362/308
7,798,681 B2 * 9/2010 Wang et al. ..... 362/351
7,857,495 B2 * 12/2010 Misawa et al. ..... 362/511
7,942,560 B2 * 5/2011 Holder et al. ..... 362/545
8,033,693 B2 * 10/2011 Tan et al. ..... 362/347

* cited by examiner

*Primary Examiner* — Anabel Ton
(74) *Attorney, Agent, or Firm* — Donald R. Boys; Central Coast Patent Agency, Inc.

(57) ABSTRACT

The invention relates to an illumination device for an automobile with at least one light source (11) to emit light and at least one cup (or bowl)-shaped reflector (10) to reflect at least a portion of the light emitted by the light source (11). The reflector (10) is formed as a light-conductor structure (12) with a totally-reflecting reflection surface (16). The light-conductor structure (12) includes at least one light-coupling surface (13) and at least one light-decoupling surface (15). The reflection surface (16) is formed as a border surface of the light-conductor structure (12). It is proposed that either the light-coupling surface (13) and/or the light-decoupling surface (15) and/or the reflection surface (16) of the reflector (10) include means to deflect the light beams passing through them or reflected by them. Thus, the reflector (10) can form light radiated from the light source (11) in conjunction with light-coupling surfaces (13), reflection surfaces (16), and light-decoupling surfaces (15) to realize a desired light distribution.

26 Claims, 7 Drawing Sheets

ILLUMINATION DEVICE

CROSS-REFERENCE TO RELATED DOCUMENTS

Figure 1:
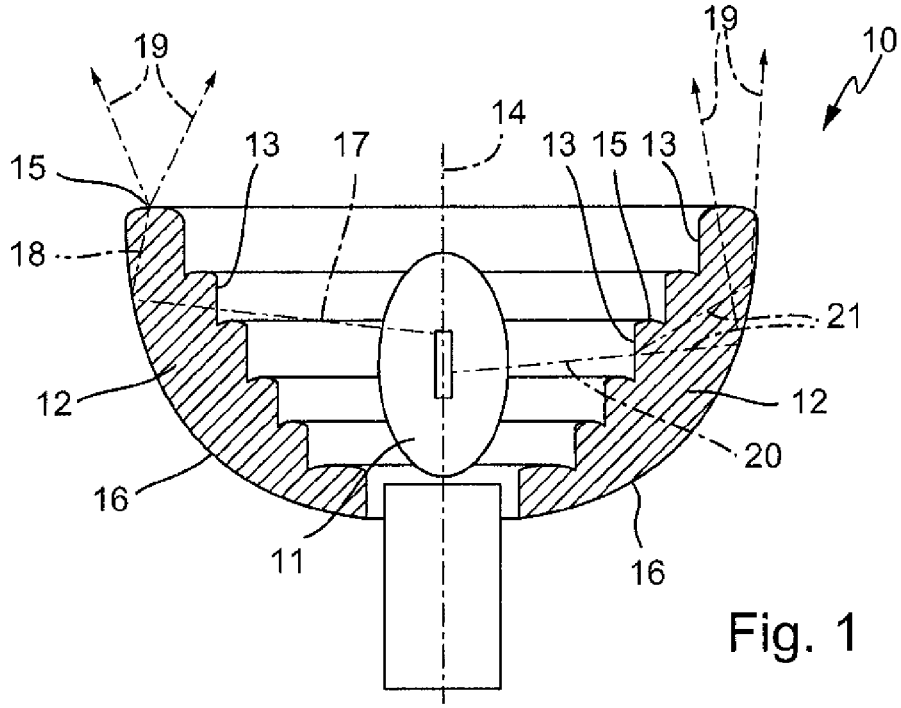

The present application claims priority to German patent application serial number DE 10 2008 035 765.0, which was filed on Jul. 31, 2008, which is incorporated herein in its entirety, at least by reference.

The invention relates to a lighting device for an automobile, preferably a lighting unit, with at least one light source to radiate light, and at least one cup (or bowl)-shaped reflector to reflect at least a portion of the light emitted from at least a singular light source onto a reflection surface of the reflector. The reflector is formed as a light-conductor structure with a totally-reflecting reflector surface. At least one first partial surface facing toward one of the optical axes is formed as a light-coupling surface, and at least a second partial surface is formed as a light-decoupling surface. At least one partial surface facing away from one of the optical axes of the light-conductor structure serves as the reflection surface. Of course, other partial surfaces of the light-conductor structure may be formed as reflection surfaces.

Reflectors that bundle light on the basis of total reflection are known to the State of the Art. In total reflection, a light beam coming from a medium that is more optically dense and that strikes a border surface of a medium that is less optically dense is reflected at the border surface when the incidence angle of the light beam exceeds a defined limiting angle (critical angle) (Comment: the incidence angle is measured with respect to a perpendicular to the border surface). This means that mirror surfaces and/or metallized surfaces may at least partially be abandoned for reflectors.

A lighting device of the type mentioned at the outset is known, for example, from GB 408,366. This known lighting device includes a light source with a filament to emit light, and an essentially cup (or bowl)-shaped, transparent reflector of glass that operates according to the principle of total reflection. Partial surfaces are provided on the inner side of the reflector facing the optical axis to couple light. Optically-active elements in the form of prisms, slots, or grooves are formed on these partial surfaces that provide for a limited lateral scattering of incident light beams. The actual scattering of incident light beams, however, occurs by means of the longitudinal extent of the filament of the light source.

Use of a reflector of the known lighting device with light sources including one or more light-emitting diodes (LED's) is not possible since LED's essentially represent point light sources, so that scattering of the light emitted from the light source based on the longitudinal extent of the light source practically does not occur with LED's. Thus, if LED's are used as a light source in the known lighting device, the degree of effectiveness is worsened because less light would be totally reflected, and a desired, legally-prescribed light distribution could not be realized, or could be realized only poorly.

Additionally, lighting devices are known from the State of the Art with LED's as the light sources and attached optical elements to bundle the light beams emitted from the LED's. The attached optical elements are formed as light conductors that bundle the light according to the principle of total reflection. The attached optical elements are formed in such a way that they surround the LED's to the greatest spatial angle possible. The light-coupling surfaces are essentially smooth, and are particularly without optically-active elements. In any case, the total coupling surface of an attached optical element includes a single optically-active element, e.g., in the form of a convex lens. Also, the attached optical elements are not cup (or bowl)-shaped, since they possess a solid interior. Such lighting devices with attached optical elements are known, for example, from DE 197 28 354 A1 and DE 10 2004 036 850 A1.

Starting from the described State of the Art, it is the task of this invention to configure and expand a lighting device of the type mentioned at the outset in such a way that a highly-efficient total reflection reflector is realized at the lowest possible cost, and in particular is intended for use with LED's.

To solve this task, it is proposed starting from the described State of the Art that a minimum of one light-coupling surface and a minimum of one light-decoupling surface and/or the reflection surface of the reflector include means for the targeted diversion of light passing through it or reflected by it, so that the reflector of the light from the minimum of one light source forms a desired light distribution in collaboration with light-coupling surfaces, reflection surfaces, and light-decoupling surfaces. Diversion means may be formed on one or several of the three various surface types: light-coupling surfaces, light-decoupling surfaces, and reflection surfaces.

The reflector based on the invention is preferably used in a lighting unit, e.g., a taillight, backup light, turn signal, fog light, or brake light, in a marker light, or in an active clearance light of an automobile. It requires no reflection surface, i.e., one may do away with the reflections from reflection surfaces. It is preferably manufactured from a transparent plastic, e.g., PMMA (poly-methyl acrylate; also known as Plexiglas or acrylic glass) or PC (Poly-carbonate), but it may also be manufactured of shatter-proof glass. The targeted configuration of the light-coupling surfaces, light-decoupling surfaces, and/or reflection surfaces of the light-conductor structures allows the light distribution of the lighting device to be intentionally varied. For this, at least one of the light-coupling surfaces, light-decoupling surfaces, and/or reflection surface elements includes means to divert the light. These diversionary elements may include several of the surfaces, or even all of the surfaces. Because of the variation options of the diversionary elements on the light-coupling surface, light-decoupling surface, and/or reflection surface of the lighting device, the light beams may be manipulated such that, when viewed from the outside with the lighting device switched on, an effective impression is created that supports the function of the particular lighting unit to an appropriate extent.

Thus for example a higher degree of effectiveness is expected when signaling with a brake light in contrast to a backup light, with the result being that a following driver executes an intuitive, very rapid performance of a braking function. For this, light emission may be adjusted in such a way by the configuration of the reflector and/or the diversion means that the lighting unit is clearly visible to a following driver at his eye level, and with less scattering. Configuration of the reflector and/or of the diversion means for a backup light, in contrast, may possess a greater degree of scattering so that the vehicle may be recognized not only directly from the rear, but also at oblique rearward angles, or even from the side of the rearward direction. Configuration of the reflector and/or the diversion means for a turn signal should also be such that the light distribution possesses a relatively high degree of lateral scattering. Each light function places varying requirements on the light reflector in order to comply with legal restrictions and to produce the optimum effect, and can easily be realized using the reflector based on the invention through various configurations of the elements used to divert the light beams.

Additionally, the use of point-source light sources in the form of LED's becomes possible through the invention because of the configuration and positioning of the diversion means on the light-coupling surfaces, light-decoupling surfaces, and/or reflection surfaces without decreasing the degree of effectiveness when compared to conventional light sources.

Because of the transparency of the reflector, it is conceivable to position additional light sources behind the reflector that pass light through the reflector during a switched-on or switched-off state of the lighting device that may be used to generate an additional light distribution, or to support the light distribution generated by the lighting device. It is thus conceivable, for example, to realize an additional blinking function for a taillight by means of at least one additional light source positioned behind the reflector in a lighting device.

Advantageous embodiments and expansions of the invention are listed in the Dependent Claims. Additional characteristics significant to the invention, and advantages connected with them, are described in the following Description and shown in the Figures, whereby these characteristics may be significant to the invention both intrinsically and in various combinations without explicit reference to them.

It is proposed that the light-decoupling surface extend essentially perpendicular to the optical axis. Thus, the light emitted from the light source is simply diverted within the light-conductor structure essentially along the light exit direction of the reflector. Details of light scattering and diversion may be realized by means of potential configurations of the light-decoupling surfaces.

It is thus further proposed that the diversion means surround a first radial wave pattern about the circumference of the reflector. For this, the wave pattern may be wave-shaped (e.g., sine and/or cosine function, or an overlapping of several such functions) or curved (e.g., polynomial function of the $n^{th}$ order, spline function), or it may possess radials (e.g., compiled from various circular arcs), or it may be in any free shape. The wave pattern may be formed on all of the light-conductor structure or only on part of it, i.e., the light-coupling surface and/or the light-decoupling surface and/or the reflection surfaces. This means that, using almost any positioning and configuration of the diversion means on the light-conductor structure, the light beams emitted from the light source may be formed or diverted in order to create a prescribed light distribution as desired.

For this reason, it is particularly advantageous if the diversion means mounted on the minimum of one light-coupling surface and/or the minimum of one light-decoupling surface include a second wave pattern spreading out essentially radially and/or parallel to the optical axis of the reflector. In conjunction with the wave pattern extending about the circumference of the reflector, three-dimensional patterns may thus be formed with locally-differing amplitudes and curvatures. Naturally, the configuration of the light-coupling surface may be different than that of the light-decoupling surface and/or reflection surface. The optimum configuration of the reflector for a specific lighting function may thus be determined in the laboratory either empirically or through mathematical simulation of the light distribution of the lighting device achieved by positioning or shaping the reflector.

For completion of the configuration options of the reflector and/or of the light-conductor structure, it is additionally proposed that the diversion means formed on the reflection surface include a third radiating wave pattern extending along the surface of a rear apex to a front edge of the reflector. The reflection surface represents the border surface between a medium that is more optically dense (the light-conductor structure) to a medium that is less optically dense, from which the light beams within the light conductor undergo total reflection. This border surface essentially corresponds to the exterior wall of the reflector. The exterior wall is preferably ellipsoid-, paraboloid-, or hyperboloid-shaped, or of a free shape deviating from one of these shapes. The formation of a wave pattern on the reflection surface does not change the basic shape of the reflector wall, but the diversion of the light beam may be thus advantageously varied depending on the striking point on the reflection surface. For this, the wave pattern may also extend obliquely (i.e., not in a circular plane) across the reflection surface.

Regarding another deviating configuration of the wave pattern, it is proposed that the diversion means on the light-coupling surface and/or the light-decoupling surface and/or the reflection surface include surface sections be arched toward the optical axis of the reflector. For this, the arched surface sections may all possess a specific radius of the same magnitude, or the surface sections may possess different radii. Also, the surface sections may be arched convex or concave. This means that the light-coupling surfaces include a series of adjacent cylindrical sections at different stages surrounding the inner side of the reflector. These cylindrical sections may thus extend toward the circumference, or they may extend parallel to the optical axis of the reflector. A combination of the two types of cylindrical sections is possible. This results in cushion-shaped surface sections. Additionally, the cylindrical sections may be tilted with respect to one another.

Expanding this concept, it is proposed that the surface sections distributed about the circumference of the light-coupling surface, light-decoupling surface, and/or reflection surface be arched to a varying degree. Depending on the desired light distribution of the reflector, a more or less strong scattering of the light beams may be achieved, and the progression of the light beams may be varied within the light-conductor structure such that light for a defined lighting function and/or specific areas of the reflector the light is bundled, while other areas in contrast reflect the light essentially parallel to the optical axis and additionally other areas reflect the light in divergence.

It is further proposed that an outer circumference shape of the reflector be configured to essentially be elliptical, particularly circular, or four-sided, particularly rectangular or square, or many sided. Along with the shape of the reflector outer wall, the circumference shape of the reflector may be freely configured since the multiple configuration options of the light-conductor structure may compensate from an optical point of view for an unfavorable circumference shape that, may be recommended for design reasons.

It is proposed based on a particularly advantageous embodiment of the lighting device that the outer shape of the light-conductor structure is provided with facets as used for diamonds. The light-conductor structure preferably includes on its underside an essentially centered recess to accommodate the light source. The outer circumference of the diamond-type light-conductor structure is multi-sided or circular. The underside of the diamond-type light-conductor structure or a wall of the central recess thus represents the light-coupling surfaces and/or the reflection surfaces. Along with a new design, the faceting allows enlargement of the surface, particularly in the area of the light-decoupling surface of the light-conductor structure. This may be achieved, for example, in that the individual facets are folded about an edge extending essentially radially. Each individual facet may moreover be further inclined, arched, or provided with optically-active media. This allows a particularly large degree of design freedom, and options to realize the desired light distribution are improved. This embodiment further offers the option of optimally realizing the light distribution of the reflector required by law, where a large amount of light is required in the central area of the light distribution, particularly in its width. The diamond-type light-conductor structure may also be designed to be open on its upper side in the area of the central recess that is opposite the light source.

It is particularly advantageous if the reflector is at least partially transparent. This is possible without further ado with a totally-reflecting reflector, and offers numerous options for innovative, eye-catching designs of the reflector, which, along with the design of the automobile body, provides an effective impression. Thus, the reflector may be almost 100% transparent, or may include only a certain degree of transparency. The reflector may also be at least partially tinted with a color. It may also possess a varying degree of transparency or color merely in certain sections.

Moreover, a transparent reflector offers the advantage that additional light sources may be mounted behind the reflector. This may be exclusively for design reasons, and/or it may, for example, allow integration of two lighting functions into one lighting module, which, for example, is worthwhile when combining a taillight and a brake light. Thus, the reflector may provide the backup-light function, while additional light sources are mounted behind the reflector to realize the brake-light function. This leads advantageously to an effective, compact multi-function lighting device.

According to another embodiment example of the lighting device, it is proposed that the light source is formed by a light-decoupling surface of at least one additional light conductor into which several light-conductor strands merge into which light from several separately-mounted light sources is coupled. This means that, to strengthen the light strength, the light from several light sources (e.g., LED's) mounted completely independently of one another is compiled into the additional light conductor, and the light-decoupling surface of the additional light conductor assumes the actual position of the light source.

Further, a lighting device is proposed in which, at least in areas or sections, small particles are embedded into the light-passing reflector body. These particles are preferably opaque, and are formed, for example, as tinsel or similar.

Figure 2:
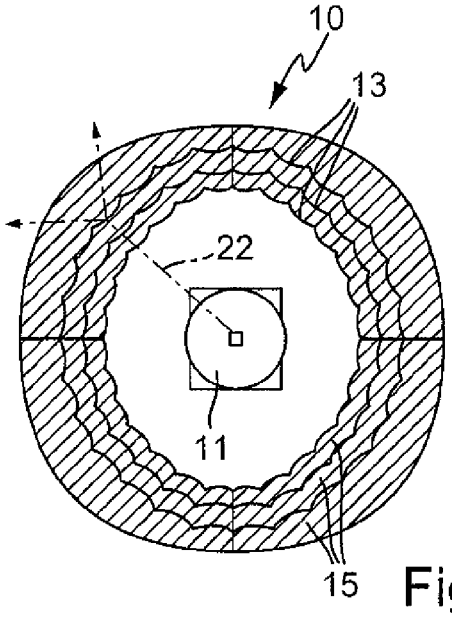
Figure 3:
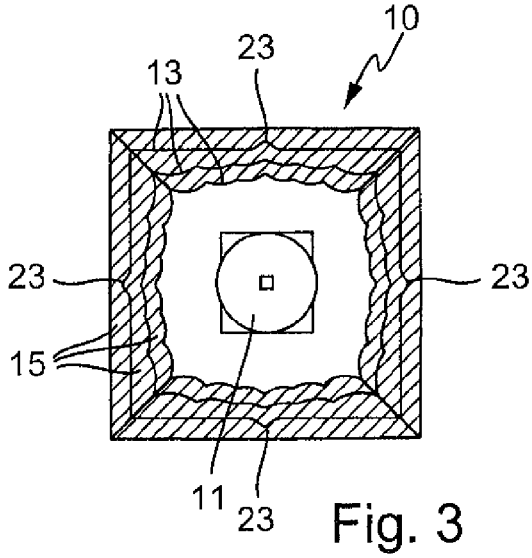
Figure 4:
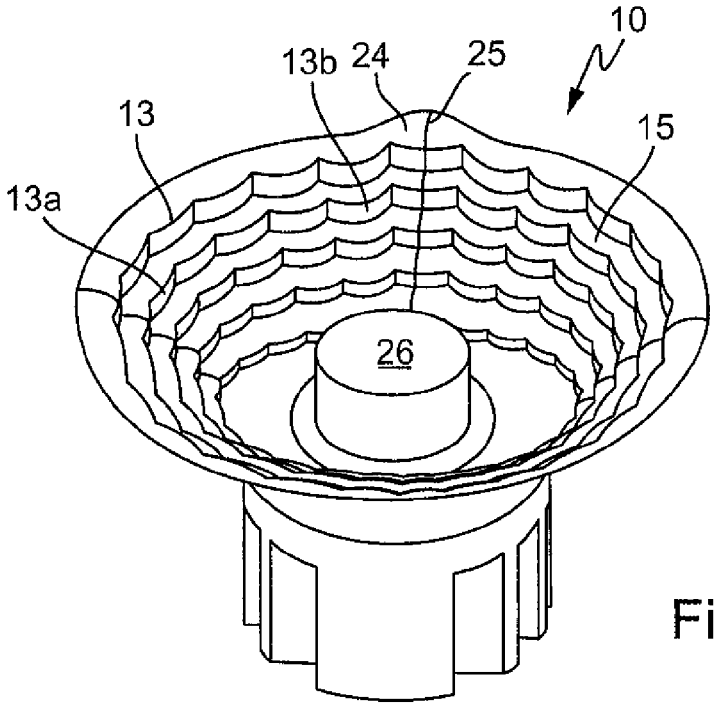
Figure 5:
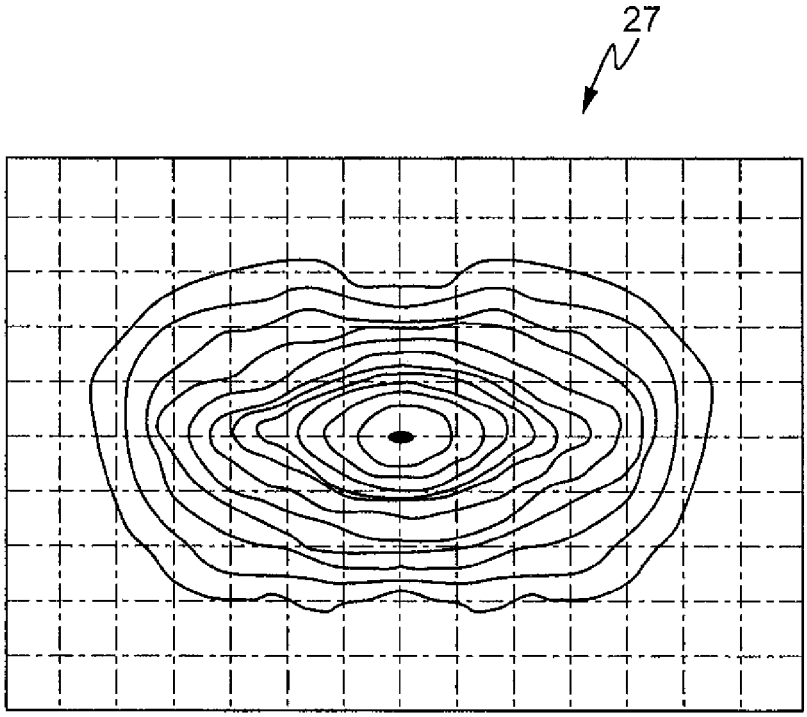
Figure 6:
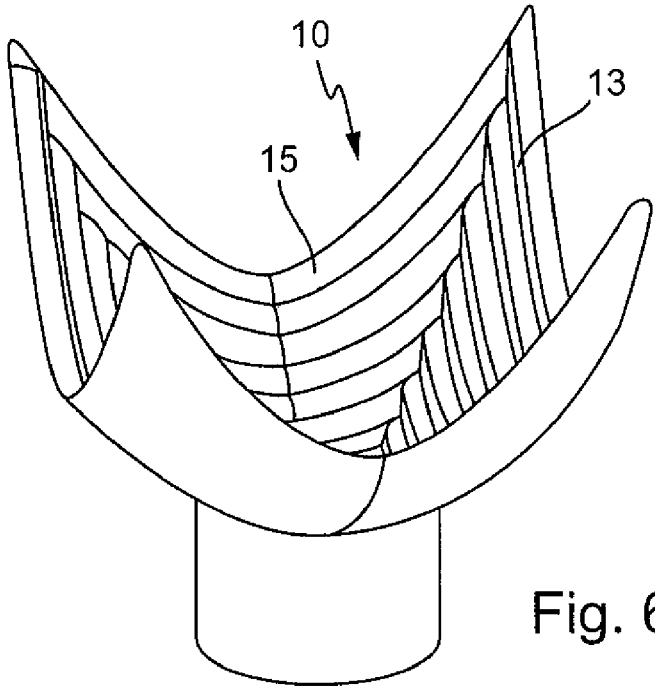
Figure 7:
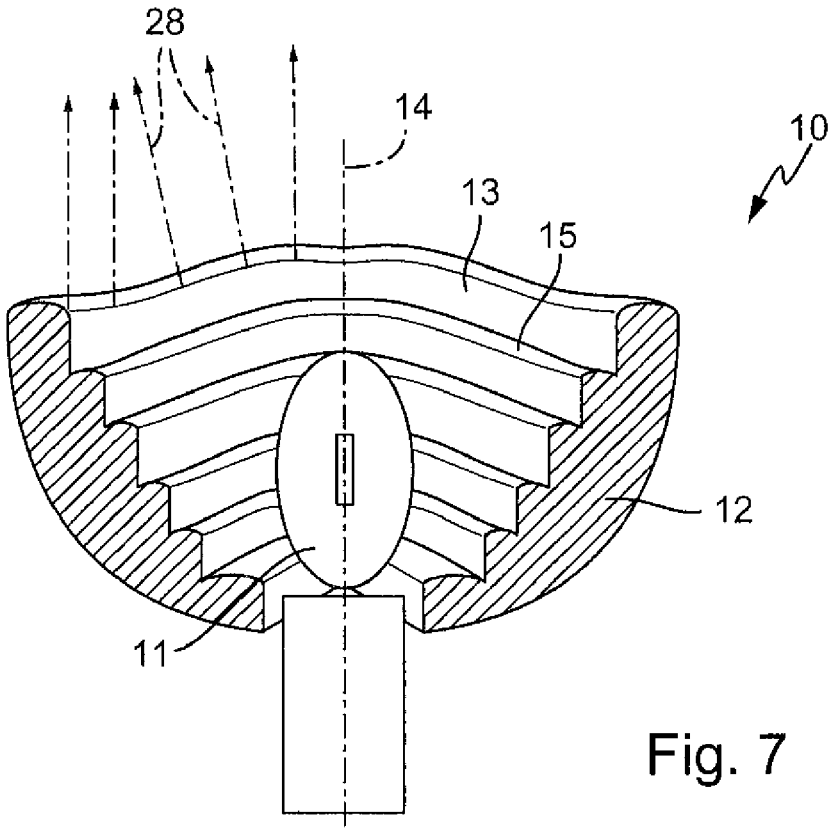
Figure 8:
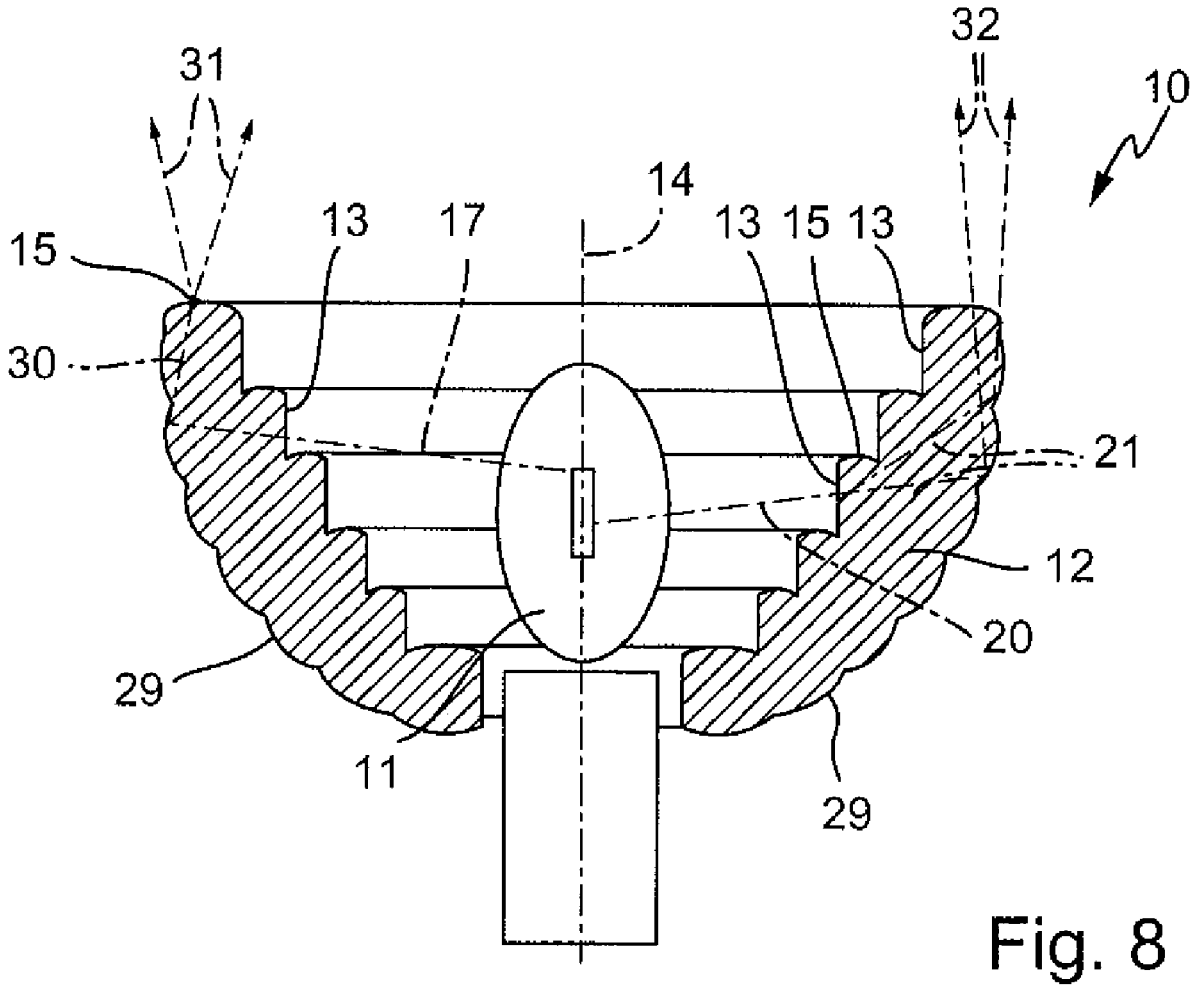
Figure 9B:
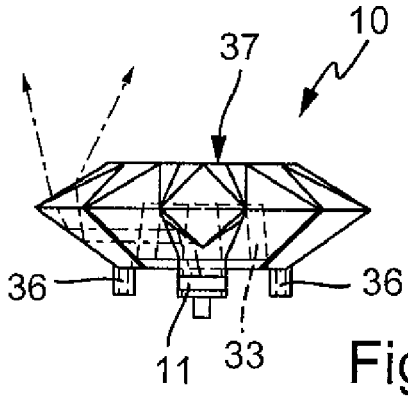
Figure 9C:
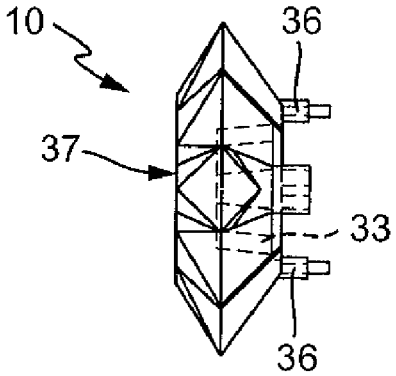
Figure 9A:
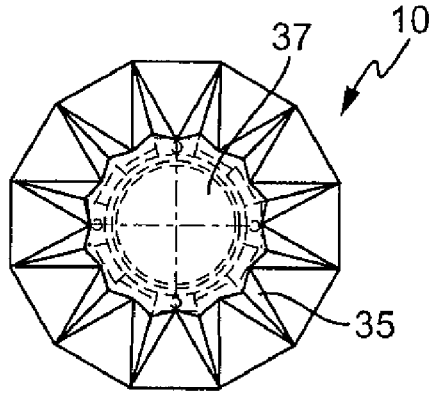
Figure 9D:
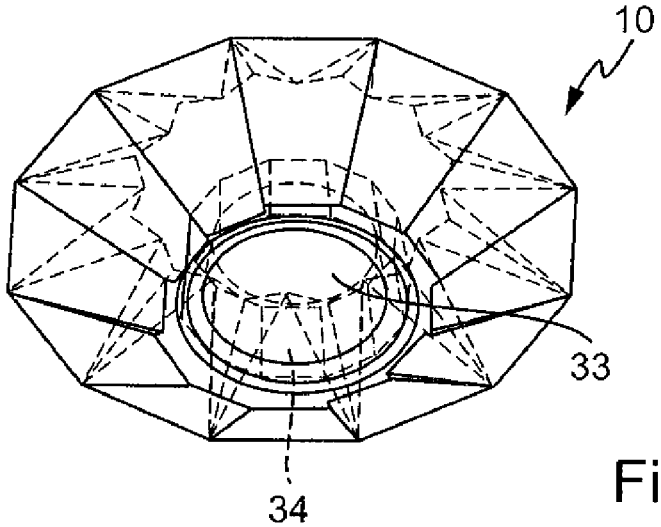
Figure 10:
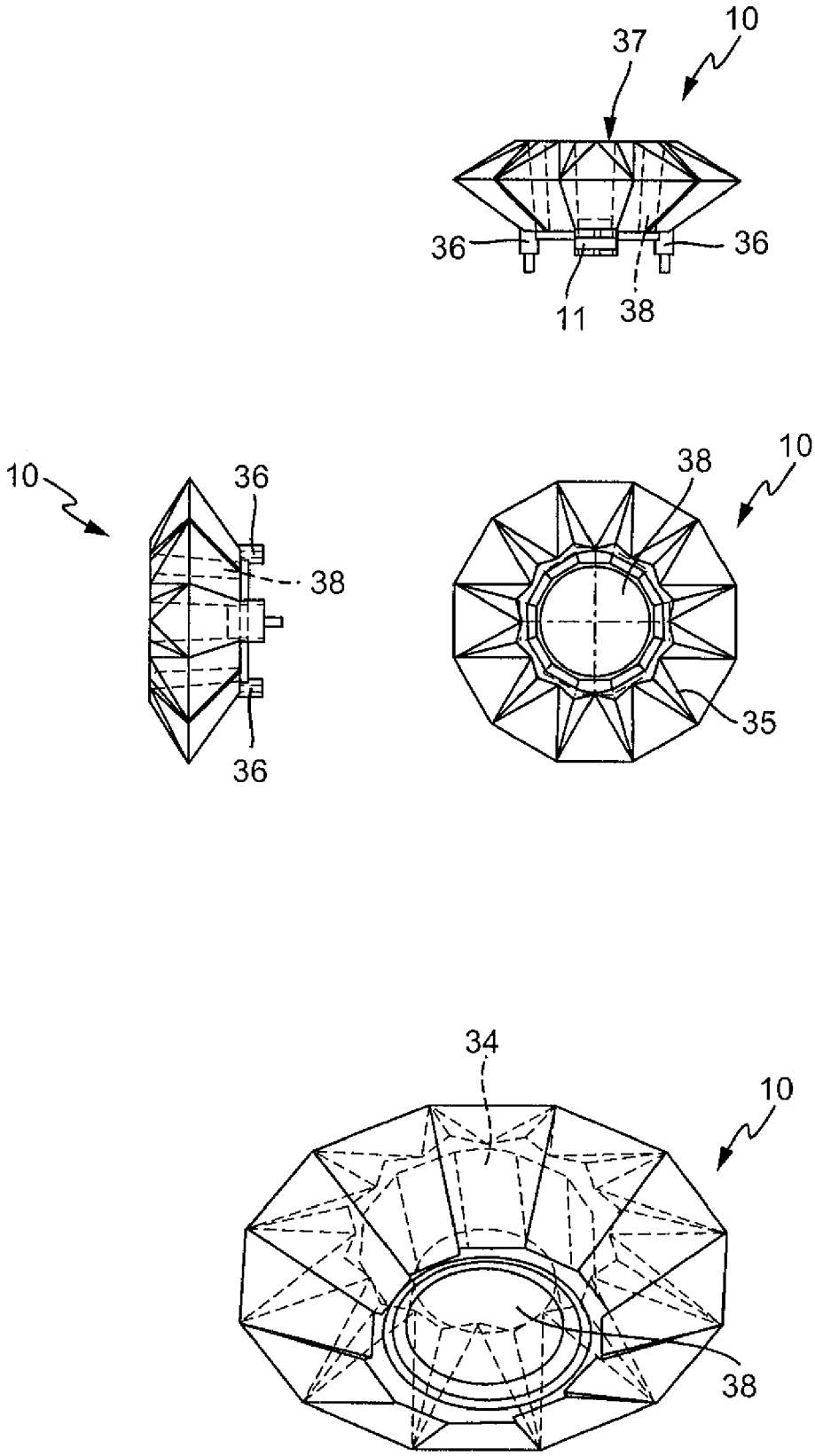
Figure 11:
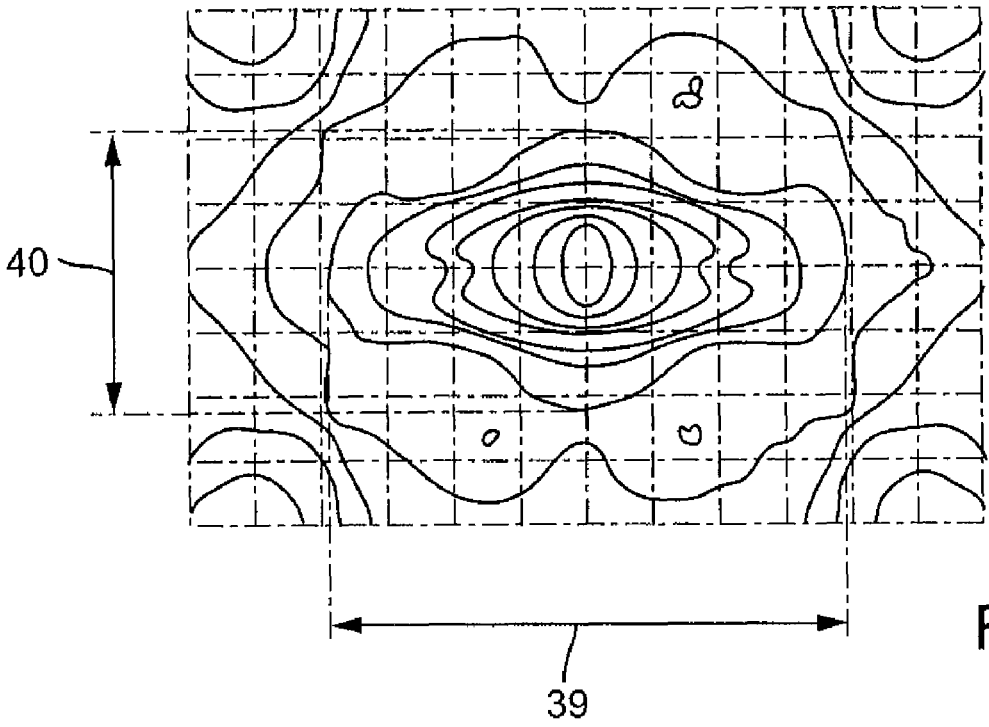
Figure 12:
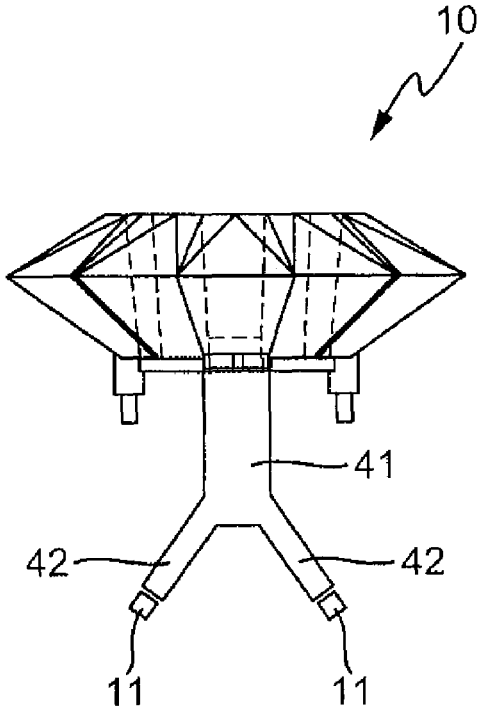

In the following, several embodiments of the invention are described in greater detail using Figures, which show:

FIG. 1 longitudinal cutaway view of a portion of a lighting device based on the invention per an advantageous embodiment;

FIG. 2 top view of a portion of a lighting device based on the invention per a first advantageous embodiment;

FIG. 3 top view of a portion of a lighting device based on the invention per a second advantageous embodiment;

FIG. 4 perspective view of the lighting device per FIG. 2, with partial cutaway;

FIG. 5 diagram of light distribution of the lighting device in FIG. 4;

FIG. 6 perspective view of the lighting device per FIG. 3, with partial cutaway;

FIG. 7 perspective view of a lighting device based on the invention per a third embodiment, with partial cutaway;

FIG. 8 perspective view of a lighting device based on the invention per a fourth embodiment, with partial cutaway;

FIG. 9 two lateral views, a top view, and a perspective view from above of a lighting device based on the invention per a fifth embodiment with closed surface;

FIG. 10 two lateral views, a top view, and a perspective view from above of a lighting device based on the invention per a sixth embodiment with open surface;

FIG. 11 diagram of light distribution of the lighting device from FIG. 9 or 10;

FIG. 12 schematic lateral view of a lighting device per a seventh embodiment.

In automobile lighting devices, along with reflectors with a mirror reflection surface, reflectors are also used that involve the physical principle of total reflection. In total reflection, a beam of light coming from a material that is more dense optically strikes a border surface of a material that is less dense optically, and is reflected by the border surface if the incident angle of the light beam exceeds a specific angle (critical angle) with the border surface. This angle is measured from a perpendicular to the border surface. This means that, in such reflectors, mirror surfaces need not be used.

Such reflectors include a light-conductor structure with a light-coupling surface facing toward a light source and by means of which the light beams are coupled into the reflector; a light-decoupling surface by means of which light beams are decoupled from the light conductor; and a reflection surface at which the light beams are totally reflected once or more on their path from the light-coupling surface to the light-decoupling surface. The light-conductor structure preferably consists of a transparent material, particularly a plastic (e.g., PMMA or PC) or glass, and is structured such that the light emitted from the light source strikes the light-coupling surface at a slight incident angle and is coupled into the light-conductor structure. Because of the geometrical configuration of the light-coupling surface, coupled light is diverted and/or scattered intentionally so that the light beams strike the reflection surface of the light-conductor structure at an angle greater than the critical angle. The above-mentioned physical rules of total reflection apply here. By means of the particular positioning and configuration of the various surfaces of the light-conductor structure, the light beam may be intentionally diverted or formed such that it exits from the light-conductor structure at a desired angle to the light-decoupling surface. The size of the critical angle is therefore dependent on the optical refractive index of the two optical media involved.

FIG. 1 shows a cross-section view of a principle diagram of such a reflector based on the principle of total reflection (so-called Total Internal Reflection, or TIR). Overall, it is labeled with reference index 10. The reflector consists of a material possessing a refractive index of n that preferably lies within the range of n=1, 4-1, 7, particularly within the range of n=1, 49-1, 59. The reflector 10 is a component of a lighting device based on the invention that additionally includes a lamp 11, which preferably is mounted at a focal point of the reflector 10. In addition to the reflector 10 and the lamp 11, the lighting device may also contain a housing, a projection lens, a light-masking device, or a masking arrangement (none shown). The reflector 10 is preferably ellipsoid-shaped, paraboloid-shaped, hyperboloid-shaped, or of a free shape deviating from one of these. The wall of the reflector 10 represents an essentially cup (or bowl)-shaped light-conductor structure 12 within whose interior the light source 11 is positioned. The light source 11 preferably includes at least one LED.

The light-conductor structure 12 includes several light-coupling surfaces 13 essentially directed radially into the interior of the cup (or bowl)-shaped structure 12. On the left side of the reflector 10 in FIG. 1, the light-coupling surfaces 13 are flat and parallel to an optical axis 14 of the reflector 10. On the right side of the reflector 10 in FIG. 1, the light-coupling surfaces 13 are arched toward the inner side of the cup (or bowl)-shaped structure 12. In the illustrated embodiment example, the arches extend longitudinally toward the circumference. It is also conceivable, however, that the arches extend longitudinally essentially parallel to the optical axis 14. Further, the light-conductor structure 12 possesses light-decoupling surfaces 15, which extend essentially radially in the illustrated embodiment example, i.e., crosswise to the optical axis 14. The light-decoupling surfaces 15 are formed to be arched on both sides of the reflector 10 in FIG. 1. The longitudinal extension of the arches thus is toward the circumference. It is conceivable, of course, for the arches of the light-decoupling surfaces 15 to extend radially. The reflection surface and/or border surface of the light-conductor structure 12 is designated with the reference index 16, and are shown in the illustrated embodiment example without light-diversion means, or essentially smooth.

The Reflector Operates According to the Following Principle:

On the left side of the reflector 10 in FIG. 1, a light beam 17 emitted from the light source 11 strikes (as an example) the light-coupling surface 13 at a relatively small incidence angle, and is coupled by it into cup (or bowl)-shaped light-conductor structure 12. The light beam 17 then strikes the reflection surface 16 at an angle greater than the critical angle, and is reflected back by it into the light-conductor structure 12 as a light beam 18 under the rule of total reflection. The reflected light beam 18 possesses a component toward the circumference and a component toward one of the light-decoupling surfaces 15. It should be noted that the passage of the light beams 17, 18 (especially their spatial angle) to the light-coupling surface 13, the light-decoupling surface 15, and the reflection surface 16 in the two-dimensional representation of FIG. 1, may only inadequately be reproduced, so that the angles shown act more steeply than actually occurs.

On the right side of the reflector 10 in FIG. 1, a light beam 20 emitted from the light source 11 strikes (as an example) the light-coupling surface 13. Thus, the light beam 20 is scattered within the light-conductor structure 12 as a light beam 21. Subsequently, the scattered light 21 is reflected back from the reflection surface 16 under the rule of total reflection into the light-conductor structure 12, and is diverted toward one of the light-decoupling surfaces 15. This means that the right side of the reflector 10 shown in FIG. 1 creates a different partial light distribution than the left side because of the differently-configured light-coupling surfaces 13.

FIGS. 2, 3, 4, 6, 7, 8, 9, 10 and 12 show additional embodiment examples of the invention. Identical parts or beam paths are labeled with consistent reference indices, and will not be described in greater detail. It should be noted that the differing properties within the individual embodiment examples may be realized independently or in combination other embodiment examples.

FIG. 2 shows a reflector 10 with an outer shape that approaches a circle in its upper area. The outer shape is transformed to an elliptical shape toward the apex of the reflector 10. In the illustrated embodiment example, the reflector 10 includes only three stages with light-coupling surfaces 13 that face radially inward with the surfaces extending essentially parallel to the optical axis 14, and with light-decoupling surfaces 15 with the surfaces extending essentially crosswise to the optical axis 14. The quantity of shown stages is an example, and may deviate from this in a specific implementation. The light-decoupling surfaces 15 are of unequal sizes, whereby particularly the upper light-decoupling surface 15 possesses significantly greater area than the light-decoupling surfaces 15 mounted closer toward the apex. The light-coupling surfaces 13 possess cylindrical sections radially arched inward. The longitudinal extension and the radii of the arches thus vary between individual cylindrical sections positioned toward the circumference. Thus, it is clearly visible, for example, that the radii of the cylinder sections at 12, 3, 6, and 9 o'clock possess greater radii, i.e., are arched less strongly, than the radii of the interposed cylinder sections.

The arches on the light-coupling surfaces 13 have the effect that the light emitted from the light source 11 (shown by light beam 22 in the embodiment example) is scattered at the light-coupling surface 13. The scattered light is subsequently passed based on the rules described above into the light-conductor structure 12 toward one of the light-decoupling surfaces 15, where it may then exit.

FIG. 3 shows a reflector 10 with an essentially square outer shape, whereby the arched shape of the sides toward the apex of the reflector 10 increases outward, i.e., away from the optical axis 14. The reflector 10 possesses three stages with light-coupling surfaces 13 and light-decoupling surfaces 15. The light-coupling surfaces 13 possess varying shape from the upper area of the reflector 10 to the lower area. Thus, the uppermost stage includes a light-coupling surface 13 with an essentially flat upper surface. Only at 12, 3, 6, and 9 o'clock, or approximately in the center of each side surface, does the light-coupling surface 13 include a small arched dent 23 extending radially outward. This dent 23 is continued in a weakened manner to the lower apex area of the reflector 10. Also, the flat surface of the light-coupling surface 13 near the edge transforms into a surface with surrounding surface sections that increase toward the apex, e.g., radially-arched cylinder sections as the light-coupling surfaces 13 progress toward the apex area of the reflector 10.

FIG. 4 shows a perspective view of a reflector 10 corresponding in principle to the configuration shown in FIG. 2. For the sake of clarity, only one light-coupling surface and only one light-decoupling surface are designated with the reference indices 13 and 15. The reflector 10 shown in FIG. 4 possesses five stages with light-coupling surfaces 13 and light-decoupling surfaces 15. In contrast to FIG. 2, FIG. 4 shows a reflector 10 that possesses arches 24 extending radially upward at a defined central position 25 on the uppermost (positioned nearest the reflector edge) light-decoupling surface 15. The light-coupling surfaces 13 possess surrounding surface sections arched radially inward, e.g., cylinder sections that possess decreasing radii toward the central position 25. A surface section with a large radius is designated with reference index 13*a*, and a surface section with a small radius is designated with reference index 13*b*. The light distribution 27 achieved by this configuration is shown in FIG. 5. Also, LED's with suitable additional optical elements 26 are used for the reflector 10 shown in FIG. 4.

FIG. 6 shows a potential configuration of the reflector shown schematically in FIG. 3, but with a square outer shape. Here also, for the sake of clarity, only a single light-coupling surface and a single light-decoupling surface are provided with reference indices. In contrast to the embodiment in FIG. 3, the reflector 10 shown here possesses no light-diverting media on the light-coupling surfaces 13 or the light-decoupling surfaces 15. The light-decoupling surface 15 is provided with continuous radii.

FIG. 7 shows a reflector 10 with six stages of light-coupling surfaces 13 and light-decoupling surfaces 15. The light-coupling surfaces 13 include flat, smooth surfaces extending essentially parallel to the optical axis. The light-decoupling surfaces 15 possess a first wave pattern with their longitudinal axis toward the circumference. Also, an additional wave pattern is formed on the light-decoupling surfaces 15 extending essentially perpendicular to the first wave pattern (longitudinal axis of the waves of the second wave pattern extends essentially radially) and overlaps it. Because of the wave pattern, the light-decoupling surfaces 15 do not extend in a plane crosswise to the optical axis 14 of the reflector 10. By means of the described configuration of the light-decoupling surfaces 15, one achieves a particularly effective scattering of the light beams at the light-decoupling surface 15 (see reference index 28). An incandescent lamp is used as light source 11. Of course, any other light source might be used.

FIG. 8 shows a reflector 10 with six stages of light-coupling surfaces 13 and light-decoupling surfaces 15 that correspond in principle to the reflector 10 in FIG. 4. An incandescent lamp used as light source 11. Of course, any other light source might be used. The light-coupling surfaces 13 include, as is seen in FIG. 4, cylinder sections arched radially inward whose longitudinal axis extends parallel to the optical axis 14. The light-decoupling surfaces 15 possess an arched surface whereby the longitudinal axes of the arches extend toward the circumference. In contrast to all other embodiment examples, the reflection surface 16 here possesses a wave pattern 29 that spreads along the surface from the apex to the edge of the reflector 10. Configuration of the reflection surface 16 with the wave pattern 29, one gains another opportunity to influence the light at the reflection surface 16 (adjacent to the light-coupling surface 13 and the light-decoupling surface 15. The passage of light beams in one of these embodiments will be shown using two examples:

A light beam 17 emitted from the light source 11 strikes the light-coupling surface 13 at a steep angle. The light beam 17 is coupled into the light-conductor structure 12 via the light-coupling surface 13, and passed to the wave pattern 29 of the border surface 16. At the light-coupling surface 13, no recognizable scattering occurs in FIG. 8. It is, of course, conceivable that the light beam 17 is scattered at the light-coupling surface 13 and/or is scattered toward the circumference of the reflector 10. At the reflection surface 16, the light beam is reflected as light beam 30 at an angle determined by the wave pattern 29. The reflected light beam 30 is diverted toward one of the light-decoupling surfaces 15, by means of which it is then decoupled out of the light-conductor structure 12. During this, the light beam 30 is diverted by the arching of the light-decoupling surface 15, and exits the light-conductor structure 12 as light beam 31.

A different light beam 20 emitted from the light source 11 strikes the light-coupling surface 13, and is scattered there by the configuration of the light-coupling surface 13. Subsequently, the scattered light beams 21 are reflected at an angle prescribed by the wave pattern 29. The reflected light beams 21 are then diverted toward the light-decoupling surface 15, by means of which they are then decoupled as light beams 32. In FIG. 8, the progression of the light beams at the light-coupling surface 13, the light-decoupling surface 15, and the wave pattern 29 of the reflection surface 16 are not shown in all details in the two-dimensional representation of FIG. 8, the shown angles may be incorrect.

FIG. 9 shows a reflector 10 in a form with significant modified components. The outer shape of the reflector 10 is provided with facets as used for diamonds and is configured along the circumference with many sides (in the illustrated embodiment example, 12 sides). Individual facets are partially folded about an edge extending essentially radially so that a top view of the reflector 10 shows a star-shaped pattern 35. Additional flat facets are positioned between the facets forming the star points. The individual facets represent the light-decoupling surfaces 15 and/or the reflection surfaces 16 of the reflector 10.

The reflector 10 includes on its underside an essentially central recess 33 to accommodate the light source 11. It is thus covered from above (see FIG. 9*a*), and includes on its upper side a central, largely flat surface section 37. The walls 34 of the central recess 33 are essentially smooth, and has many sides (e.g., 12 sided) when viewed from beneath. The walls 34 represent the light-coupling surface 13 of the reflector 10. In a lower area, the reflector 10 includes a device that accommodates the light source 11. Additionally, the reflector 10 possesses two support legs in its lower area for the installation and securing of the reflector 10 in the lighting device.

In another embodiment example (not shown), the star-shaped mounted facets on the upper side of the reflector 10 converge toward the center so that no flat surface section 27 is formed, but rather an apex is formed.

FIG. 10 shoes in principle the same reflector 10 as in FIG. 9. The single difference is that the central recess 33 in FIG. 9 to accommodate the light source 11 is formed in FIG. 10 as an aperture 38. The reflector 10 is thus open upward, and the flat surface section is gone.

FIG. 11 shows a diagram with a light distribution that is achieved by means of a reflector 10 as in FIG. 9 or 10. In the diagram, areas with the same light intensity are shown using lines (so-called Isocandela lines). The difference in the light distribution in FIG. 5 is the fact that a central area with a relatively strong light intensity in FIG. 11 is formed to be larger than for the light distribution 11 in FIG. 5. The light distribution in FIG. 11 has a particularly broad width 39 and a large height 40. The light distribution in FIG. 11 approaches a light distribution in the form of a cross, while the light distribution in FIG. 5 possesses an elliptical character. The reflector 10 in FIG. 9 or 10 thus fulfills the laws regarding light distribution, and causes an optimal signaling function of the lighting unit from subjective perspectives.

FIG. 12 shows another embodiment example of a lighting device. The shown light-conductor structure of the reflector 10 is identical to the light-conductor structure in FIG. 9 or 10. In FIG. 12, however, a light-decoupling surface of an additional light-conductor structure 41 is positioned in the area that accommodates the light source in FIG. 9 or 10. The light-conductor structure 41 possesses several light-conductor strands 42 on a side opposite the light-decoupling surface that feed into the common light-conductor structure 41. Light is coupled into the light-conductor strand 42 from a separately-positioned light source 11, e.g., an LED. Naturally, more light sources may be coupled into additional light-conductor strands 42.

The invention claimed is:

1. Lighting device for an automobile with at least one light source adapted for emitting light and at least one bowl-shaped reflector adapted for reflecting at least a portion of the light emitted by the at least one light source at a reflection surface of the reflector, whereby the reflector is formed as a light-conductor structure adapted for reflecting light according to the principle of total internal reflection, whereby at least one first partial surface of the light-conductor structure facing toward an optical axis of the reflector is formed as a light-coupling surface and at least one second partial surface is formed as a light-decoupling surface, and whereby the reflection surface is formed on at least one partial surface of the light-conductor structure facing away from the optical axis, wherein at least one of the at least one light-coupling surface the at least one light-decoupling surface and the reflection surface of the reflector includes means for selectively deviating light passing through it or reflected from it so that the reflector forms a desired light distribution from light emitted from the at least one light source in cooperation with the at least one light-coupling surface, the at least one reflection surface, and the at least one light-decoupling surface, and wherein the at least one light source is located within the concavity of the bowl-shaped reflector.

2. Lighting device as in claim 1, characterized in that the lighting device is formed as an automobile lighting unit.

3. Lighting device as in claim 1, characterized in that the light-decoupling surface extends essentially perpendicular to the optical axis.

4. Lighting device as in claim 1, characterized in that the deviating means include a first wave pattern spreading along the circumference of the reflector.

5. Lighting device as in claim 4, characterized in that the at least one light coupling surface, the at least one light-decoupling surface, or the at least one reflection surface comprising the first wave pattern is not rotationally symmetrical with respect to the optical axis of the reflector.

6. Lighting device as in claim 4, characterized in that the deviating means formed on at least one of the at least one light-coupling surface the at least one light-decoupling surface comprises a second wave pattern extending essentially parallel to the optical axis of the reflector or radially or extending substantially parallel to the optical axis of the reflector and radially.

7. Lighting device as in claim 6, characterized in that the light-coupling surface or the light-decoupling surface comprising the second wave pattern is not rotationally symmetrical with respect to the reflector's optical axis.

8. Lighting device as in claim 4, characterized in that the deviating means formed on the reflection surface comprise a third wave pattern extending along a surface extension from an apex to an edge of the reflector.

9. Lighting device as in claim 1, characterized in that the deviating means formed on at least one of the at least one light-coupling surface, the at least one light-decoupling surface or the at least one reflection surface comprise surface sections arched toward the optical axis of the reflector.

10. Lighting device as in claim 9, characterized in that the surface sections are arched to be convex.

11. Lighting device as in claim 9, characterized in that the surface sections are arched to be concave.

12. Lighting device as in claim 9, characterized in that the arched surface sections are formed to be cylindrical, whereby longitudinal axes of the cylinders extend essentially parallel to the optical axis of the reflector.

13. Lighting device as in claim 12, characterized in that the longitudinal axes of the cylinders extend slightly inclined by a few degrees in respect to a parallel relative to the reflector's optical axis.

14. Lighting device as in claim 9, characterized in that that the curves of the arched surface sections comprise a specific radius.

15. Lighting device as in claim 14, characterized in that the arched surface sections positioned in a ring about the optical axis of the reflector at least partially comprise different radii.

16. Lighting device as in claim 14, characterized in that the arched surface sections positioned in different rings about the optical axis of the reflector at least partially comprise different radii.

17. Lighting device as in claim 1, characterized in that the light-conductor structure comprises an essentially central recess on its lower surface adapted for accomodating the light source, and the outer shape of the light-conductor structure is faceted like a cut diamond, and is formed as a polygon along its circumference.

18. Lighting device as in claim 17, characterized in that a wall of the central recess represents the light-coupling surface and surfaces of the light-conductor structure directed outward radially represent the light-decoupling surfaces or the reflection surfaces, or the light-decoupling surfaces and the reflection surfaces.

19. Lighting device as in claim 17, characterized in that the central recess is open in an area opposite the light source.

20. Lighting device as in claim 2, characterized in that an external circumference contour of the reflector is essentially elliptical, particularly circular, or four-sided, particularly rectangular or square, or is polygonal.

21. Lighting device as in claim 2, characterized in that the reflector is at least partially transparent.

22. Lighting device as in claim 2, characterized in that the light source includes at least one LED.

23. Lighting device as in claim 2, characterized in that the light source is formed by means of a light-decoupling surface of at least one further light conductor that combines multiple light-conductor strands, into each of which light from separately-positioned light sources is coupled, the light-decoupling surface of the at least one further light conductor being located opposite to the at least one light-coupling surface of the bowl-shaped reflector.

24. Lighting device as in claim 23, characterized in that the light sources that couple light into the further light conductor are LED's.

25. Lighting device as in claim 2, characterized in that the at least one light-coupling surface, the at least one light-decoupling surface, and the at least one reflection surface are at least partially matte finished, or the at least one light-coupling surface, the at least one light-decoupling surface or the at least one reflection surface are at least partially matte finished.

26. Lighting device as in claim 2, characterized in that small particles are embedded at least in part of the reflector body.

* * * * *